US005484373A

United States Patent [19]

Carbone

[11] Patent Number: 5,484,373

[45] Date of Patent: Jan. 16, 1996

[54] KIT FOR MAKING BOXES AND METHOD FOR USING

[76] Inventor: Martin R. Carbone, 2519 Bath St., Santa Barbara, Calif. 93105

[21] Appl. No.: 165,375

[22] Filed: Dec. 10, 1993

[51] Int. Cl.[6] ..... B31B 47/00; B31B 1/62

[52] U.S. Cl. ..... 493/59; 493/70; 493/80; 493/128; 493/396

[58] Field of Search ..... 493/59, 60, 61, 493/160, 396, 397, 398, 399, 404, 406, 69, 70, 71, 72, 79, 80, 81, 128

[56] References Cited

U.S. PATENT DOCUMENTS

| | | | |
|---|---|---|---|
| 1,153,951 | 9/1915 | Plante | 493/396 |
| 1,221,213 | 4/1917 | Plante | 493/396 |
| 1,705,748 | 12/1926 | Bridgeman | 493/71 |
| 1,847,515 | 7/1930 | Holmer | 493/396 |
| 2,056,092 | 11/1935 | Claff | 493/160 |
| 2,056,093 | 9/1936 | Claff | 493/160 |
| 2,114,948 | 4/1938 | Wehner et al. | 493/397 |
| 3,596,823 | 8/1971 | Zitzelman | 229/33 |
| 4,280,810 | 7/1981 | Struble | 493/80 |
| 5,156,584 | 10/1992 | Cohen et al. | 493/396 |

FOREIGN PATENT DOCUMENTS

| | | | |
|---|---|---|---|
| 345351 | 10/1913 | France | 493/160 |

*Primary Examiner*—Bruce M. Kisliuk
*Assistant Examiner*—Christopher W. Day
*Attorney, Agent, or Firm*—Michael G. Petit

[57] ABSTRACT

A kit for making boxes from a paper card stock is described. The kit comprises a flat plate having a guide rail with a vertical edge projecting above the surface of the plate parallel to one edge of the plate. A scoring groove traverses the plate parallel to the vertical edge of the guide rail. One or more spacing strips, each having a vertical edge, may be placed between the vertical edge of the guide rail and the scoring groove to vary the depth of the box. The overall size or "footprint" of a box made in accordance with the invention is determined by the distance of the scoring groove from the nearest vertical edge and the size of the blank card stock employed. The card stock preferably comes in two sizes for each size box, one for the bottom and one for the top. The card stock used for the top is slightly larger than the stock used for the bottom so that the same spacers may be used for scoring folding lines for both the top and the bottom and, at the same time, providing a mating fit therebetween. The kit, which comprises the scoring plate, spacing strips and a scoring tool, may be used to fashion boxes in a variety of shapes as well as sizes.

2 Claims, 4 Drawing Sheets

KIT FOR MAKING BOXES AND METHOD FOR USING

BACKGROUND OF THE INVENTION

1. Field of the Invention

This invention relates to a kit for making boxes and, more particularly to a kit for making boxes in a variety of shapes and sizes.

2. Prior Art

Boxes or cartons are traditionally made from a semi-rigid cardboard stock by first cutting a cardboard blank to the desired dimensions of the outer walls and flaps. The cardboard blanks are then scored on fold lines and the scored fold lines are notched between the various flaps so that the top or bottom of the box or container may be folded. Such box making equipment usually employs a scoring and slotting machine which is adaptable for producing boxes in a variety of sizes. Such a machine is expensive and not normally available for individual use. It is, therefore, desirable to produce a versatile system for making boxes whereby one or more custom boxes may be inexpensively made by any individual at his/her home or place of work.

SUMMARY OF THE INVENTION

The present invention provides an inexpensive kit comprising the tools necessary for manufacturing boxes or containers from a card stock on a small scale. The kit of the present invention preferably has a means for making boxes in a variety of sizes, volumes and shapes. It is therefore, an object of this invention to provide a kit for making boxes from a card stock which includes components which can be readily used no additional tools or power.

It is another object of this invention to provide a kit for manufacturing boxes which enables the production of boxes in a variety of depths.

It is still another object of this invention to provide card stock blanks for tops and bottoms of boxes, which, when identically scored and folded using the kit of the present invention, matingly fit together, one over the other, in a facile manner.

These and other objects of the invention will soon become apparent as we turn now to a description of the drawings and the preferred embodiments.

DESCRIPTION OF THE PREFERRED EMBODIMENT

Figure 1:
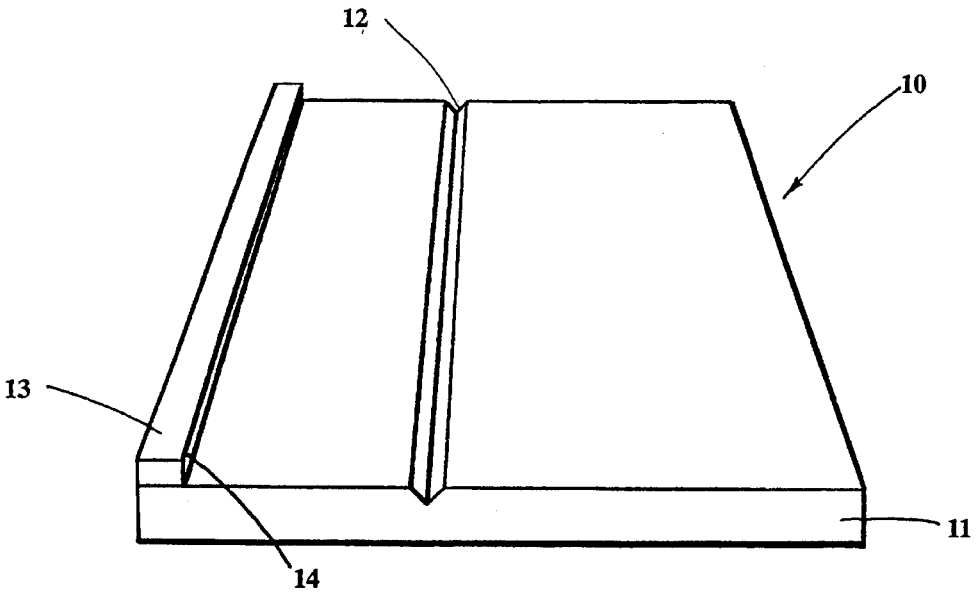
FIG. 1 shows a scoring plate in accordance with the present invention.

A scoring plate generally indicated at the numeral 10 has a flat plate portion 11 and a scoring groove 12 cut therein. A guide rail 13 has a guide rail vertical guide edge 14 which provides a vertical reference line which is parallel to both the scoring groove 12 and one edge of the plate 11.

Figure 2:
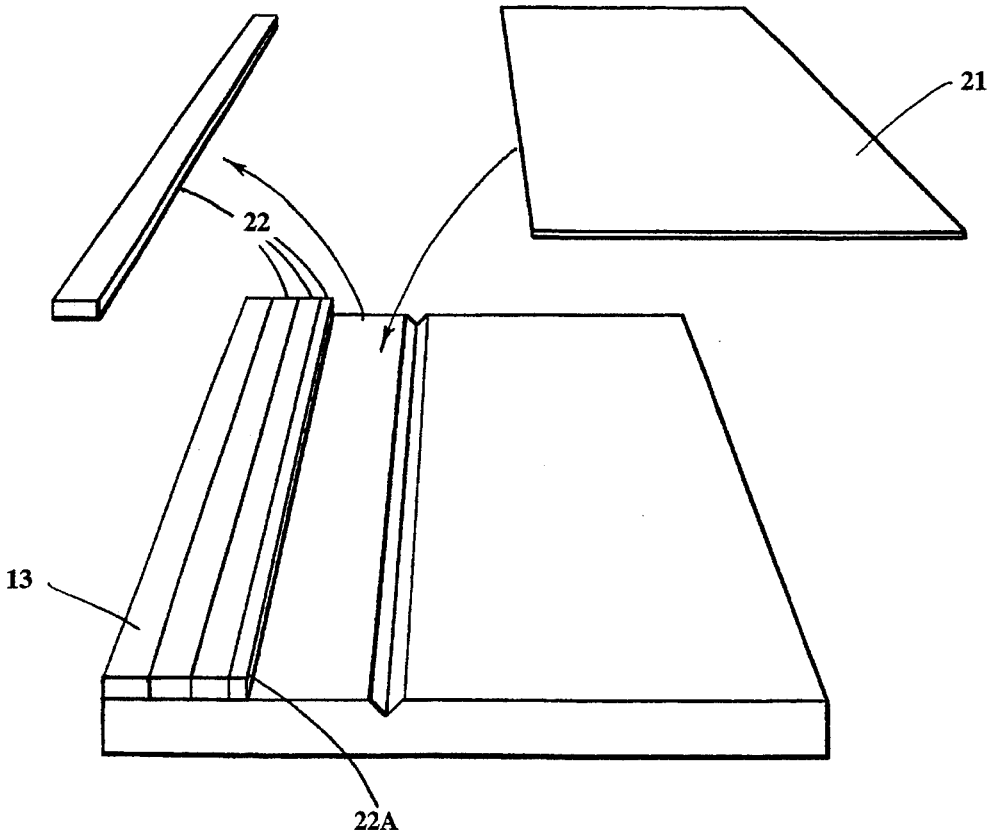
FIG. 2 shows a scoring plate with a plurality of spacing strips in position to receive a card stock blank.

Turning now to FIG. 2, a series of spacers 22 are dimensioned to fit between the guide rail 13 and scoring slot 12. The spacers 22 come in a variety of widths and lengths. The spacers 22 have a vertical edge **22*a* which provides a stop or margin against which one edge of a card stock 21 may be juxtaposed prior to scoring. While the spacers 22 may be any length and width, they are preferably in the range of ¼" to 2" in width and the same length as the scoring groove 12. The variation in distance possible between the scoring groove 12 and the vertical edge 22*a* of the spacer 22 nearest the scoring groove 12 will depend upon the particular kit, but normally is in the range of 1 inch to 12 inches for home use. It is noted that the depth of the box that is formed using the kit according to the present invention is determined by the distance between the scoring groove 12 and the vertical edge 22*a* of the spacer 22 nearest to the scoring groove 12. The distance is the maximum depth of the box. Shallower boxes are made by inserting the appropriate inserts 22 between the guide rail 13 and the scoring slot 12**.

Figure 3:
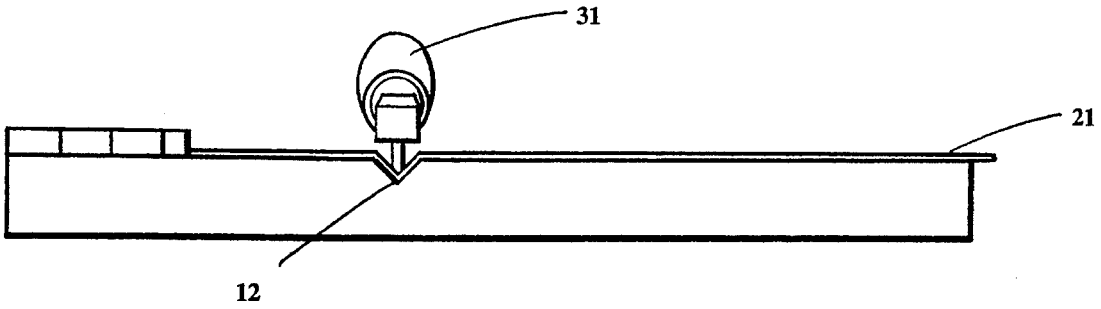
FIG. 3 is an end on view of the scoring plate of FIG. 2 with one spacer removed and a scoring tool employed to score the card stock.

Once the dimensions of the box have been determined, a blank card stock is chosen so that it will have the desired length, width and depth after folding. Card stock may be included as part of the kit or it may be purchased separately. The card stock, once selected, generally indicated at 21, is placed on the scoring plate 11 with one edge against the vertical edge **22*a* of spacer 22 nearest the scoring strip 12 as shown in FIG. 3. A scoring tool 31 is pressed against the card stock 21 to force the card stock down into the scoring groove 12** thereby scoring the card stock to generate a folding line. This procedure is repeated for the other three sides of the top or bottom.

Figure 4:
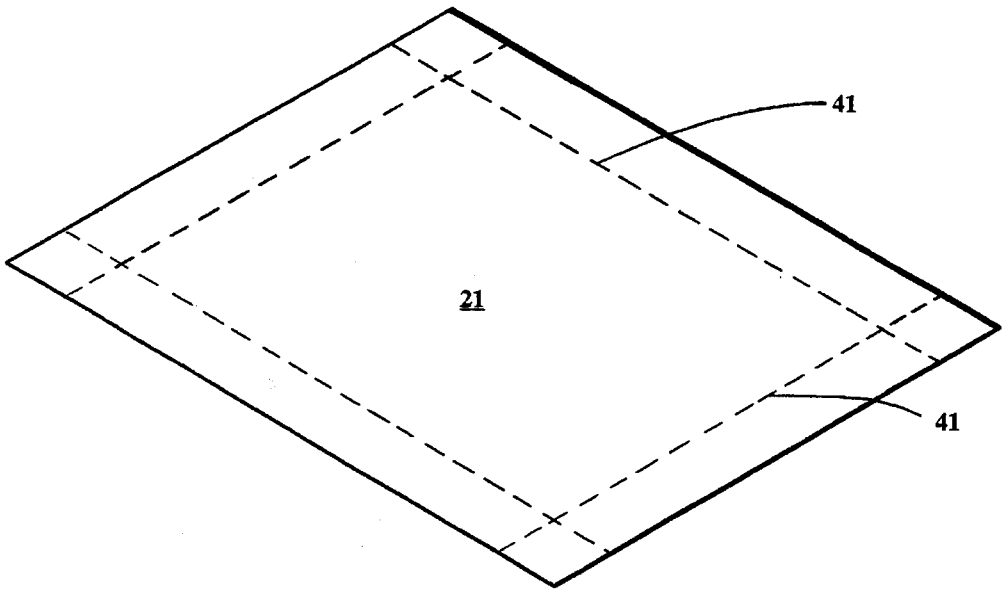
FIG. 4 is a perspective view of a box top or bottom showing the folding lines after it has been scored.
Figure 5:
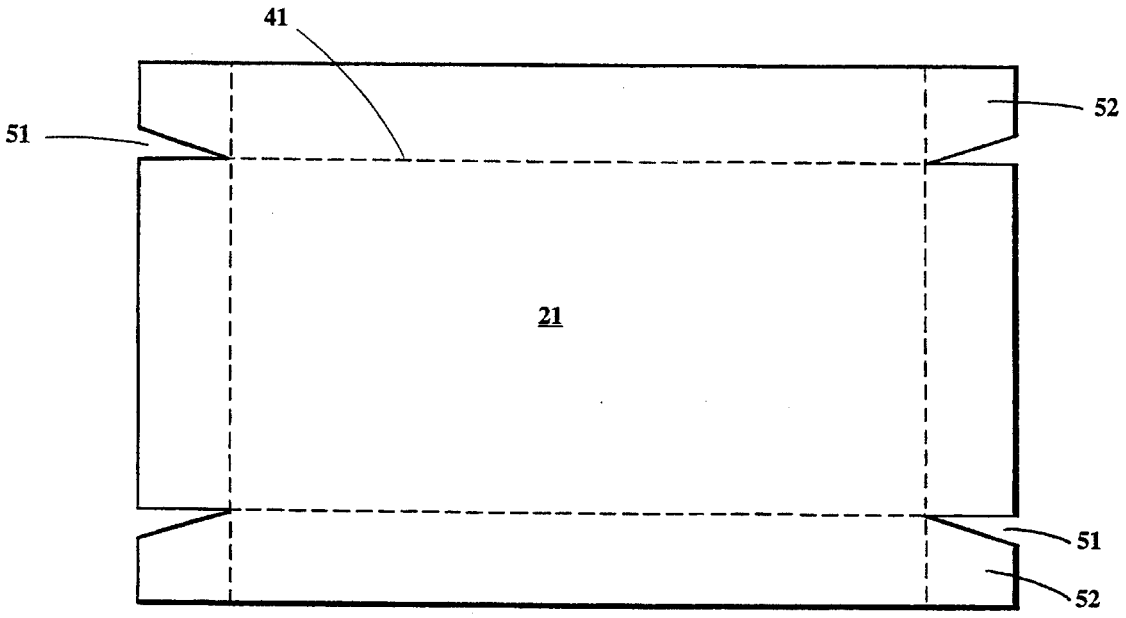
FIG. 5 shows the box top or bottom of FIG. 4 with notches cut in the square corner flaps as shown.
Figure 6:
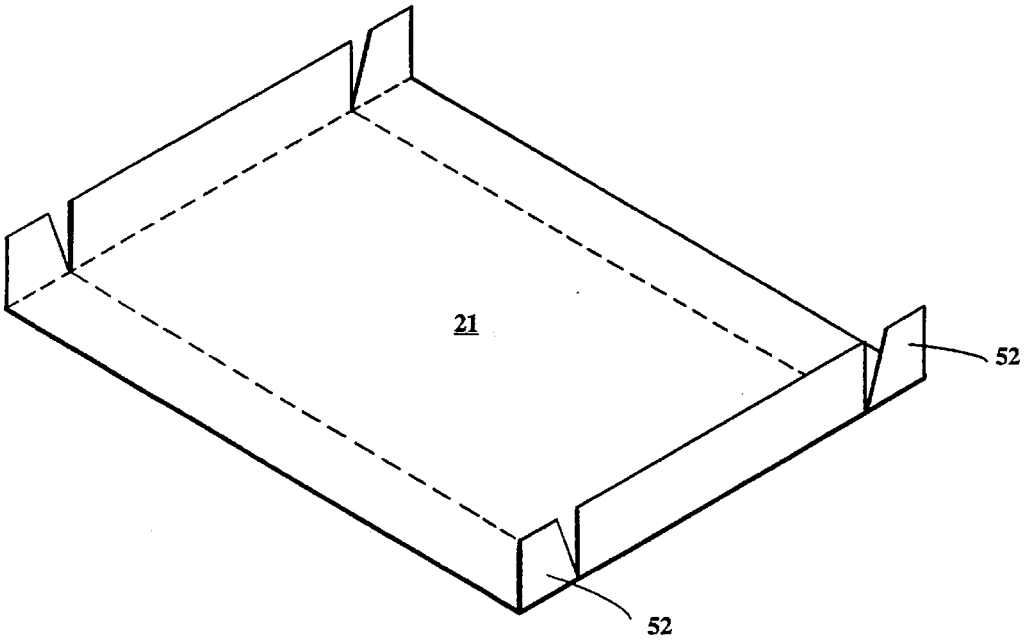
FIG. 6 shows a box top or bottom as shown in FIG. 5 partially folded along the score lines.
Figure 7:
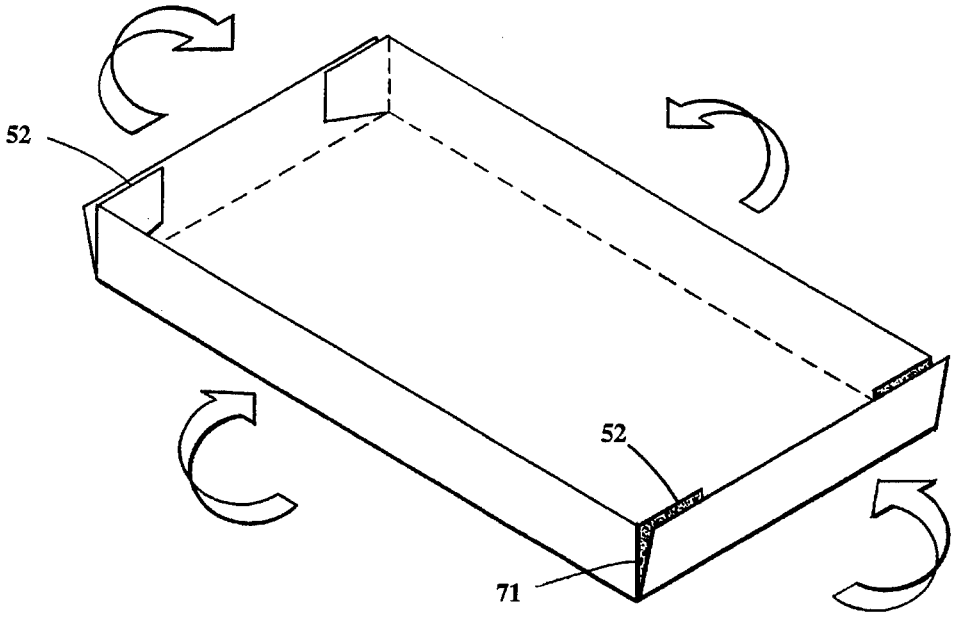
FIG. 7 shows the box top or bottom of FIG. 6 partially folded with adhesive applied to the tabs.
Figure 8:
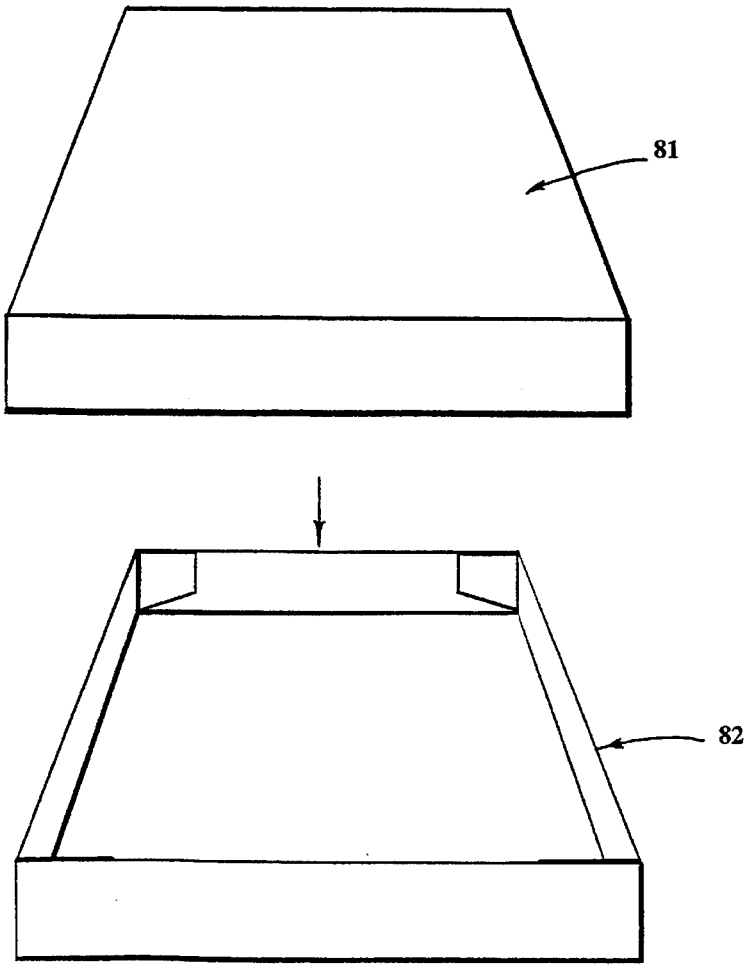
FIG. 8 shows a complete box made in accordance with the kit and method of the present invention.

Turning now to FIG. 4 we see a perspective view of the top or bottom 21 after it has been scored on all four sides clearly showing the folding lines 41. In order to fold the card stock after scoring, notches 51 are cut in the comers of the top or bottom 21 to facilitate closure. The notches 51, which may be conveniently cut with scissors or a sharp blade, may be cut out of either the longest or the shortest edge of the card stock. The box top and bottom fit together best if the notches are cut out of the shortest edge of one and the longest edge of the other. After the notches 51 have been removed from the comers to form tabs 52 as shown in FIG. 5, the top (or bottom) 21 is folded as shown in FIG. 6. Once the folds have been accomplished, an adhesive, generally indicated at 71 in FIG. 7 is placed on the tabs 52 after the folds have been made. The sides are then raised in the direction of the broad arrows and held in place by means of the adhesive 71. The procedure is repeated for the top or bottom as appropriate. The finished top 81 and bottom 82 are shown in FIG. 8. The top 81 may be easily inserted over the bottom as shown. Convenient sizes for card stocks range from 3"×3" to 11"×17". This enables the construction of boxes ranging in size from 1"×1"×1" (the smallest volume) to 15"×9"×1" (the maximum footprint) to 11"×5"×3" (maximum volume). It is preferable to provide card stock for the box top which is longer in length and width by three times the thickness of the card stock to permit a mating or nesting fit therebetween. The scoring plate and spacers are preferably made from a durable material that will not undergo delamination such as a hard wood or a plastic. The scoring tool is preferably a bent wire or a rolling wheel with a handle attached thereto. The wheel is dimensioned to fit within the scoring groove.

While particular embodiments of the present invention have been illustrated and described, it would be obvious to those skilled in the art that various other changes and modifications can be made without departing from the spirit and scope of the invention. For example, boxes may be made in many different shapes besides the rectangular shapes presented herein. They may be triangular or pentagonal or star-shaped. It is therefore intended to cover in the appended claims all such changes and modifications that are within the scope of this invention.

What I claim is:

1. A kit for making a box comprising, in combination:

(a) at least one sheet of foldable card stock material;

(b) a scoring plate having (i) a flat planar top surface dimensioned to accommodate and support a sheet of said card stock placed thereupon; (ii) a guide rail presenting a first vertical edge affixed thereto; and (iii) a scoring groove comprising an elongate straight indentation in said top surface oriented parallel to, and spaced a uniform distance from said guide rail vertical edge;

(c) a plurality of spacing strips, each one of said plurality of spacing strips having a length, a width and a second vertical edge, said width being less than said uniform distance, and wherein the length of at least one spacing strip of said plurality of spacing strips is at least as long as said scoring groove;

(d) a scoring tool operable for forcing a portion of a sheet of said card stock into said scoring groove; and (e) adhesive means operable for non-releasably joining together adjacent tabs at respective corners of said card stock sheet.

2. A method for making a box having a preferred height, said box having a bottom portion and a matingly engaging top portion, comprising the steps of:

(a) presenting a kit comprising; (i) at least one sheet of foldable card stock material; (ii) a scoring plate having (1) a flat planar top surface dimensioned to accommodate and support a sheet of said card stock placed thereupon; (2) a guide rail presenting a first vertical edge affixed thereto; and (3) a scoring groove including an elongate straight indentation in said top surface oriented parallel to, and spaced a uniform distance from said guide rail vertical edge; (iii) a plurality of spacing strips, each one of said plurality of spacing strips having a length, a width and a second vertical edge, said width being less than said uniform distance, and wherein the length of at least one spacing strip of said plurality of spacing strips is at least as long as said scoring groove; (iv) a scoring tool operable for forcing a portion of a sheet of said card stock into said scoring groove; and (v) adhesive means operable for non-releasably joining adjacent tabs at respective corners of said card stock;

(b) selecting at least one spacer strip from the kit such that the width of the spacer strip, or the total width of a combination of spacer strips, plus the preferred height equals the uniform distance between the groove and first vertical edge of the guide rail on the scoring plate;

(c) placing the spacer strip upon the top surface of the scoring plate with the second vertical edge of the spacer strip parallel to the first vertical edge of the guide rail and the width of the spacer being selected so that the distance between said second vertical edge and the scoring groove is substantially equal to the preferred height;

(d) placing a first card stock having at least three corners ad three straight edges on the scoring plate so that one straight edge of said at least three straight edges of said card stock is in contact with said vertical edge of said at least one spacer;

(e) making a straight scoring line parallel to the said one straight edge by scoring said card stock along the length of said scoring groove employing scoring tool means operable for pressing a portion of said card stock into said scoring groove;

(f) repeating steps (d) and (e) for each of said straight edges of said card stock, said straight scoring lines intersecting at a point near each corner of said card stock;

(g) making a first cut along a scoring line at each corner of said card stock, the cut extending from the point of intersection of the scoring line with the outer edge of the card stock to the point where the scoring line intersects with another scoring line;

(h) making a second cut in each corner of the card stock, the second cut being adjacent to the first cut and extending from the inner terminus of the first cut to the edge of the card stock to form a wedge shaped notch and two adjacent tabs at each corner of the card stock;

(i) folding said notched card stock along each score line to form box sides having said adjacent tabs at each corner;

(j) affixing said adjacent tabs of said card stock to one another to form the bottom portion of the box;

(k) making the top portion of the box by substituting a second card stock for the first card stock wherein the second card stock is congruent with the first card stock and wherein each of said straight edges on said second card stock is longer than the corresponding straight edge on the first card stock and repeating steps (d) through (j).

* * * * *